US008170459B2

(12) United States Patent
Shida

(10) Patent No.: US 8,170,459 B2
(45) Date of Patent: May 1, 2012

(54) PAPER COLORING APPARATUS AND IMAGE FORMING SYSTEM

(75) Inventor: Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 458 days.

(21) Appl. No.: 12/401,776

(22) Filed: Mar. 11, 2009

(65) Prior Publication Data

US 2009/0232527 A1 Sep. 17, 2009

(30) Foreign Application Priority Data

Mar. 14, 2008 (JP) ..... 2008-065481

(51) Int. Cl.

| | |
|---|---|
| ***G03G 15/00*** | (2006.01) |
| ***G03G 15/01*** | (2006.01) |
| ***G03G 21/00*** | (2006.01) |
| ***G03G 21/20*** | (2006.01) |

(52) U.S. Cl. ..... 399/341; 399/406; 399/408

(58) Field of Classification Search ..... 399/44, 399/341, 406, 407, 408

See application file for complete search history.

(56) References Cited

U.S. PATENT DOCUMENTS

| | | | | |
|---|---|---|---|---|
| 5,987,301 | A * | 11/1999 | Acquaviva | 399/406 |
| 6,052,553 | A * | 4/2000 | Acquaviva et al. | 399/406 |
| 7,471,925 | B2 * | 12/2008 | Shida et al. | 399/406 |
| 7,510,610 | B2 * | 3/2009 | Kougami et al. | 118/264 |
| 7,515,862 | B2 * | 4/2009 | Shida et al. | 399/341 |
| 7,664,422 | B2 * | 2/2010 | Shida et al. | 399/97 |
| 7,840,173 | B2 * | 11/2010 | Kougami et al. | 399/406 |
| 2007/0048048 | A1 * | 3/2007 | Kougami et al. | 399/341 |

FOREIGN PATENT DOCUMENTS

| | | | |
|---|---|---|---|
| JP | 54083431 | A * | 7/1979 |
| JP | 57211160 | A * | 12/1982 |
| JP | 63210880 | A * | 9/1988 |
| JP | 10-044388 | A | 2/1998 |
| JP | 2003-215772 | A | 7/2003 |
| JP | 2007-292914 | A | 11/2007 |

OTHER PUBLICATIONS

Japanese Office Action dated Dec. 22, 2009 (3 pages), and English translation thereof (4 pages), issued in counterpart Japanese Application Serial No. 2008-065481.

* cited by examiner

*Primary Examiner* — David Gray
*Assistant Examiner* — Fred L Braun
(74) *Attorney, Agent, or Firm* — Holtz, Holtz, Goodman & Chick, PC

(57) ABSTRACT

An image forming system includes an electrophotographic image forming apparatus which forms an image on a sheet of paper, and a paper coloring apparatus which is connected to the electro-photographic image forming apparatus. The paper coloring apparatus includes a coating apparatus having two coating rollers which coat colored water on both faces of the paper sheet on which the image has been formed by the electro-photographic image forming apparatus. A supply section selectively supplies one of the colored water and a colorless water onto the two coating rollers of the coating apparatus. And a controller is provided for switching between a coloring process to color the paper sheet by supplying the colored water onto the two coating rollers, and a humidifying process to humidify the paper sheet by supplying the colorless water onto the two coating rollers.

9 Claims, 4 Drawing Sheets

PAPER COLORING APPARATUS AND IMAGE FORMING SYSTEM

CROSS REFERENCE TO RELATED APPLICATION

The present application is based on Japanese Patent Application No. 2008-065481 filed with Japanese Patent Office on Mar. 14, 2008, the entire content of which is hereby incorporated by reference.

BACKGROUND OF THE INVENTION

1. Technical Field

The present invention relates to a paper coloring apparatus for coloring a paper sheet on which an image is formed, and to an image forming system where an image forming apparatus and/or a book binding apparatus are connected to the paper coloring apparatus.

2. Description of Prior Art

As the paper sheets to be used in the image forming apparatus, commonly used are paper sheets of white color or colors of nearly white.

However, there are requirements of taking on suitable colors such as yellow, green or red for the paper sheets, in order to attain special effects.

To respond these requirements, it is needed to previously prepare various colored paper sheets, and to load a prescribed colored paper sheet on a prescribed sheet tray before starting the image forming operation.

However, to previously prepare many various colored paper sheets suitable for the requirement may cause a cost increase, as well as a heavy load for management.

In order to lessen these inconveniences, it has been considered to execute image formation subsequently to coloring a white paper sheet, or to color the paper sheet subsequently to the image formation.

As an apparatus for coloring a paper sheet, an apparatus which colors Japanese paper by inkjet system is disclosed for example in Unexamined Japanese Patent Application Publication No. H10-44388.

However, in utilizing the inkjet system, dissatisfaction in processing speed will be remarkable in cases where almost an entire surface of the paper sheet is to be colored, or both faces of the paper sheet are to be colored.

As an apparatus which coats liquid on a paper sheet after image formation, an apparatus which applies perfume onto a photographic paper sheet after development process is disclosed for example.

However, since applying perfume on the photographic paper does not require uniform coatings to both faces of the paper sheet, the configuration of the apparatus disclosed in Unexamined Japanese Patent Application Publication No. 2003-215772 cannot be directly adapted to an apparatus for coloring a paper sheet.

SUMMARY OF THE INVENTION

A paper coloring apparatus, reflecting one aspect of the present invention, includes a coating apparatus which coats colored water on both faces of a paper sheet on which an image has been formed by an electrophotographic image forming apparatus.

An image forming system reflecting another aspect of the present invention is characterized in that the above described paper coloring apparatus is connected to an electrophotographic image forming apparatus.

An image forming system reflecting another aspect of the present invention is characterized in that the above described paper coloring apparatus is connected with a book binding apparatus, which executes book binding to the paper sheets, the book binding apparatus being connected with the paper coloring apparatus downstream of the paper coloring apparatus in a conveyance direction of the paper sheet.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Hereinafter examples of the embodiment of the present invention will be described with reference to the drawings.

Figure 1:
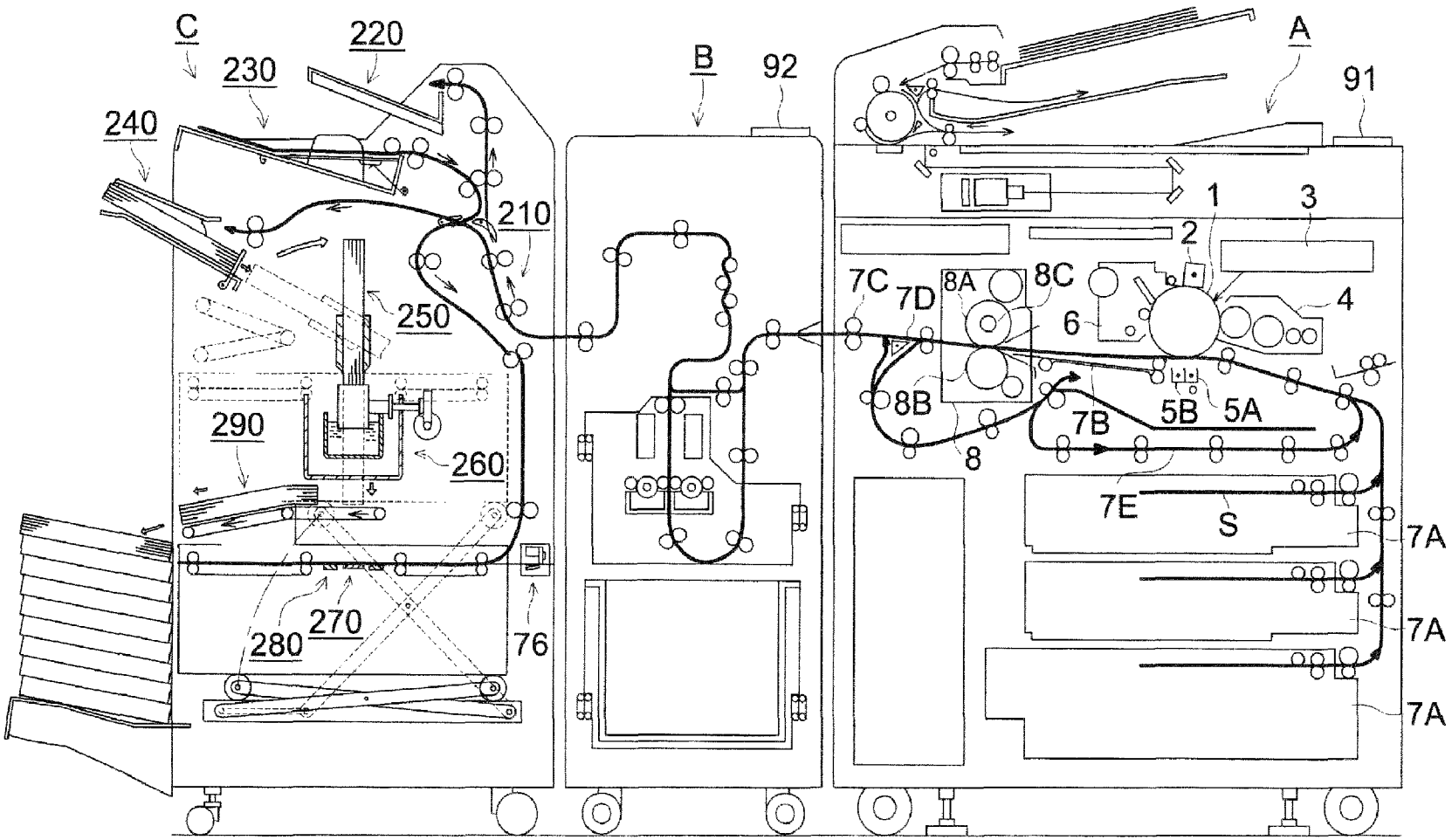
FIG. 1 is a drawing to show a configuration example of an image forming system including an image forming apparatus, a paper coloring apparatus and a book binding apparatus.

FIG. 1 is a drawing to show a configuration example of an image forming system including image forming apparatus A, paper coloring apparatus B and book binding apparatus C.

Image forming apparatus A includes an image forming section in which arranged around rotatable image carrier 1 are charging unit 2, exposure unit 3, developing unit 4, transfer unit 5A, charge neutralizing unit 5B and cleaning unit 6. In the image forming section, after charging unit 2 uniformly charges on a surface of image carrier 1, a laser beam from exposure unit 3 exposes by scanning the image carrier 1 according to image data to form a latent image on image carrier 1, and developing unit 4 develops the latent image by reversal development to form a toner image.

The toner image is transferred on to paper sheet S which has been fed from paper housing unit 7A and conveyed to the transfer position, the paper sheet S carrying the transferred toner image is neutralized of the electric charge by neutralizing unit 5B and is separated from image carrier 1, and the paper sheet S is conveyed by conveyance unit 7B to fixing unit 8.

Meanwhile, after the toner image having been transferred onto paper sheet 1, remaining toner on the surface is removed from the surface of image carrier 1 by cleaning unit 6, and the image carrier 1 is prepared for the next image formation.

Fixing unit 8 includes heating roller 8A provided with heater 8C and pressure roller 8B contacting and pressing the heating roller 8A, and fixes the toner image on paper sheet S by pressing/heating the conveyed paper sheet carrying the toner image.

Paper sheet S having been processed of image fixing by the fixing unit 8 is conveyed out of the apparatus through sheet ejection roller 7C.

In the case of executing the image formation on both faces of the paper sheet, paper sheet S having been heat-fixed by fixing unit 8 is branched from a usual sheet ejection path by conveyance path switching member 7D, reversed by being switched-back at reverse conveyance unit 7E, and sent back to the image forming section.

Paper sheet S having an image formed on the rear face is fixing processed by fixing unit 8, and conveyed out of the apparatus through sheet ejection roller 7C.

Paper sheet S conveyed out by sheet ejection roller 7*c* is sent into paper coloring apparatus B connected downstream in the sheet conveyance direction.

Paper coloring apparatus B is an apparatus for executing a coloring process and/or a humidifying process onto paper sheet S sent from image forming apparatus A connected upstream.

Paper coloring apparatus B of the present invention is provided with a first mode to convey paper sheet S from image forming apparatus A to book binding apparatus C without applying any process onto paper sheet S, a second mode to convey paper sheet S by applying a humidifying process, and a third mode to convey the paper sheet S by applying a coloring process.

Further, paper coloring apparatus B is provided with an uncurling unit to correct a curl of paper sheet S.

Selection from these modes and selection whether to apply uncurling or not are executed based on an instruction operation at operation display section 91 of image forming apparatus A or at operation display section 92 of paper coloring apparatus B, or based on an instruction from an external apparatus through a network.

Book binding apparatus C stacks the paper sheet S conveyed form paper coloring apparatus B to form a stack of paper, and makes a book by adhering a book cover on the stack of paper.

Book binding apparatus C of the present invention is configured with sheet conveyance section 210, sheet ejection section 220, book cover supply section 230, stacked paper housing section 240, stacked paper holding section 250, adhesive coating section 260, book cover adhering section 270, book cover folding section 280, and booklet ejection section 290.

As shown in the drawing of FIG. 1, each of the above-described sections is arranged vertically in the apparatus.

In cases where the mode of not applying the book binding process is set through operation display section 91 of image forming apparatus A, the conveyance path to stacked paper housing section 240 is closed and the conveyance path to sheet ejection section 220 is opened.

In cases where the book binding mode is selected, paper sheet S is housed at a prescribed position in stacked paper housing section 240 and sequentially stacked to form a stack of paper having a prescribed number of sheets.

The stack of paper formed on stacked paper housing section 240 is sent to stacked paper holding section 250, and in the state where stacked paper holding section 250 is rotated to be substantially vertical, the bottom side of the stacked paper is coated with adhesive by adhesive coating section 260, to thus the stack of paper.

Onto the stack of paper having been bound, a book cover is supplied from book cover adhering section 270 and adhered, and the book cover is folded by the book cover folding section 280, thus a booklet is formed.

The booklet formed as above is ejected by booklet erection section 290 from book binding apparatus C.

Book binding apparatus C is such an apparatus that is described in Unexamined Japanese Patent Application Publication No. 2004-209869.

Figure 2:
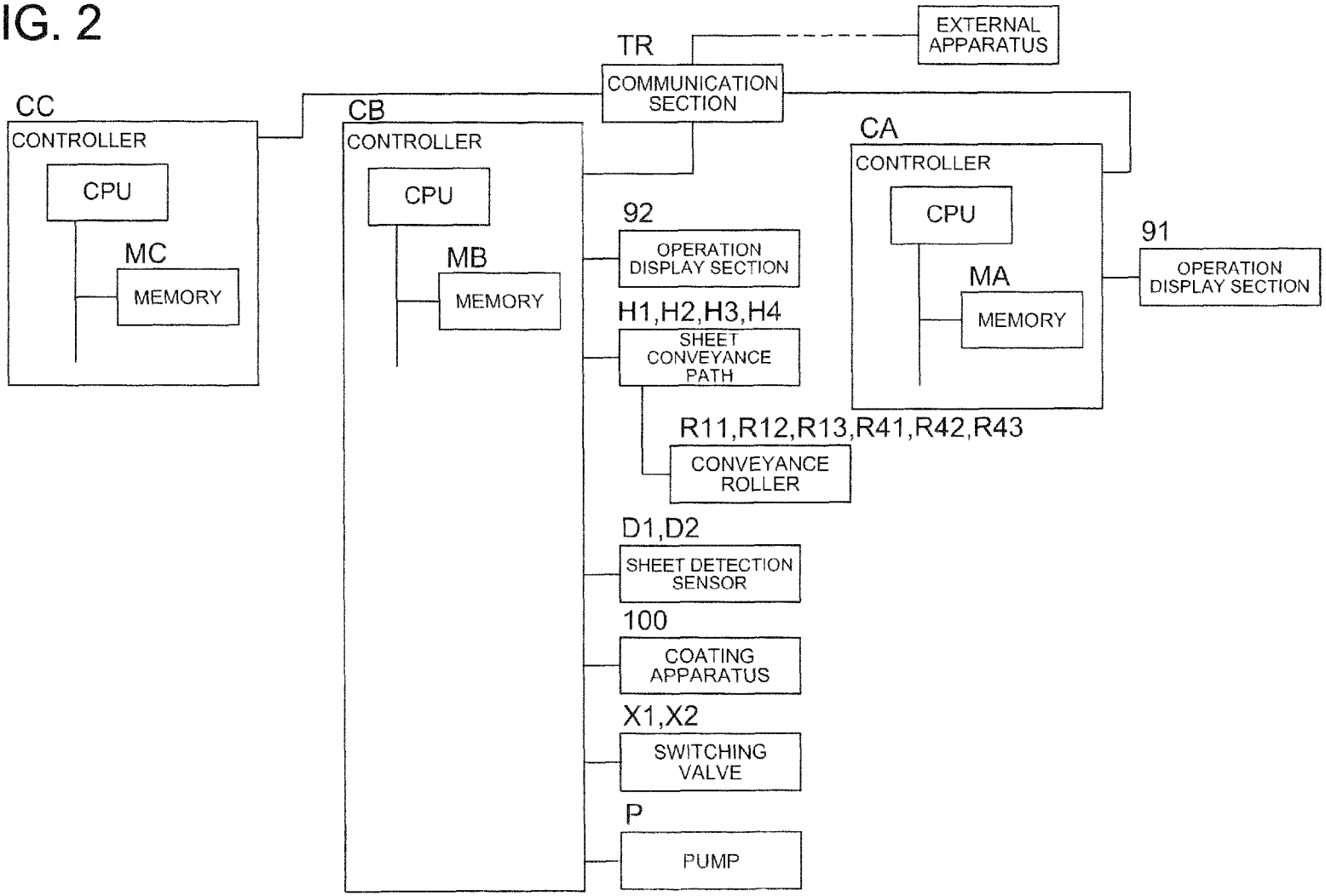
FIG. 2 is a block diagram showing a control system of the image forming system.

FIG. 2 is a block diagram showing a control system of the image forming system.

Each of controller CA of image forming apparatus A, controller CB of paper coloring apparatus B, and controller CC of book binding apparatus C is a computer system including a CPU, a memory, a computing unit, an I/O port, a communication interface, and a drive circuit, etc.

Control by each of the controllers mentioned above is performed by executing the prescribed program stored in memory MA, MB, or MC provided in the respective controller.

Further, the controllers are connected with each other through communication section TR, and are capable of communicating with each other.

In FIG. 2, blocks of features not directly related to the present invention are omitted from the description.

Figure 3:
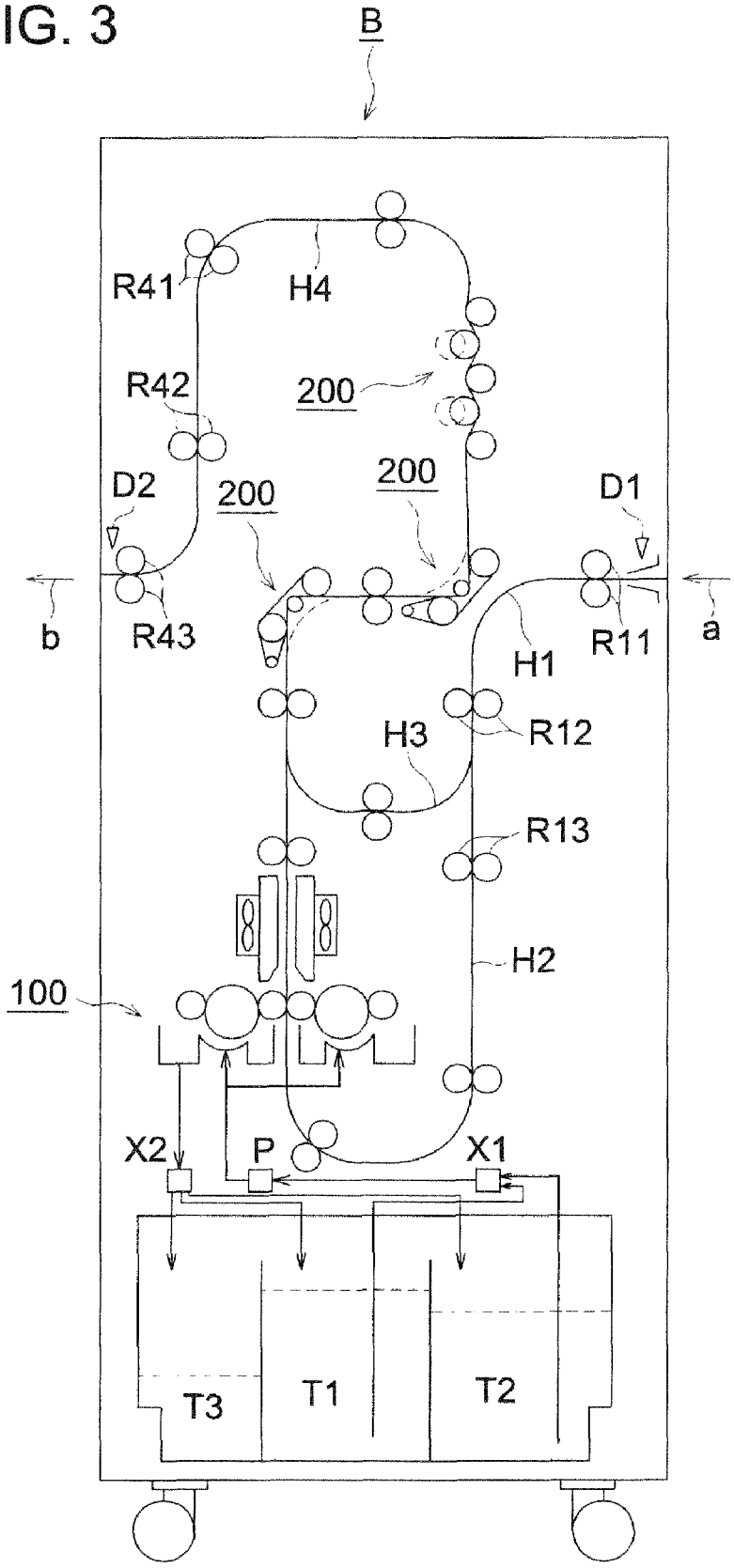
FIG. 3 is a schematic diagram of the paper coloring apparatus.

FIG. 3 is a schematic diagram of paper coloring apparatus B.

Paper coloring apparatus B of the present invention is able, in addition to performing the coloring process to color paper sheet S sent from image forming apparatus A, to perform a humidifying process for removing the curl of paper sheet S.

Paper sheet S sent from image forming apparatus A enters into paper coloring apparatus B from the direction of arrow mark "a", and goes through either of sheet conveyance paths H1, H3, and H4 or conveyance paths H1, H2, H4, and sent away to book binding apparatus C disposed in the direction of arrow "b".

Sheet conveyance path H1 is a path which takes paper sheet S sent from image forming apparatus A into paper coloring apparatus B, and conveyance path H4 is for sending paper sheet S out of the apparatus.

The above mentioned sheet conveyance paths H1, H3, H4 are the paths which are used in cases where the coloring process or the humidifying process is not applied to paper sheet S, and the above mentioned sheet conveyance paths H1, H2, H4 are the paths which are used in cases where the coloring process or the humidifying process is applied to paper sheet S.

In each sheet conveyance path, sheet conveyance means such as a plurality of guide members (not illustrated) and conveyance rollers are disposed, and paper sheet S is guided by the guide means to proceed along the prescribed sheet conveyance path.

At an entrance port and an ejection port for paper sheet S, sheet detection sensors D1 and D2 are provided respectively to detect a leading edge and a trailing edge of paper sheet S.

Detection signals of the sheet detection sensors are sent to controller CB, and based on the detection signals controller CB calculates the position of paper sheet S in the sheet conveyance paths.

Conveyance rollers R11, R12, and R13 which are disposed in sheet conveyance path H1 as the conveyance means are variable speed rollers and their rotation speed are controlled by controller CB.

Similarly, conveyance rollers R41, R42, and R43 are disposed in conveyance path H4, and their rotation speed are controlled by controller CB based on the detection signals sent from sheet detection sensor D2.

The above mentioned controller CB controls the rotation speed of each conveyance roller based on the position information of paper sheet S obtained on the basis of the detection signals from sheet detection sensors D1 and D2, and based on mode information indicating the process mode sent from controller CA of image forming apparatus A.

As described above, by providing the conveying speed varying means to vary the conveying speed of paper sheet S, in sheet conveyance path H1 for taking-in paper sheet S, or in conveyance path H4 for sending paper sheet S having been applied the prescribed process out of the apparatus, problems regarding the sheet conveyance, which are caused by the difference of conveying speed among speeds in image forming apparatus A, paper coloring apparatus B, and book binding apparatus C, can be prevented.

Sheet conveyance path H2 is a path to be selected in cases where paper sheet S is applied a coloring process by coating apparatus 130 provided in the conveyance path.

Below conveyance path H2, arranged are tank T1 for storing coloring liquid as coating liquid, tank T2 for storing water to be used for humidifying, and waste liquid tank T3 for storing waste liquid.

Waste liquid tank T3 accepts liquid mixture formed in the course of changing the coating liquid from the coloring liquid to colorless water, or changing from the water to the coloring liquid.

The coloring liquid stored in tank T1 is sent by pump P into coating apparatus 100 through switching valve X1, and overflowed coloring liquid is returned into tank T1 through switching valve X2 to be repeatedly used.

Similarly, the water stored in tank T2 is sent by pump P into coating apparatus 100 through switching valve X1, and overflowed water is returned into tank T2 through switching valve X2 to be repeatedly used.

Above coating apparatus 100, uncurling unit 200 to correct the curl of paper sheet S is provided, which is a publicly known technical means to correct the curl of paper sheet S.

As described above, the selection whether to apply uncurling or not are executed based on an instruction operation at operation display section 91 of image forming apparatus A or at operation display section 92 of paper coloring apparatus B, or based on an instruction from an external apparatus through a network.

Figure 4:
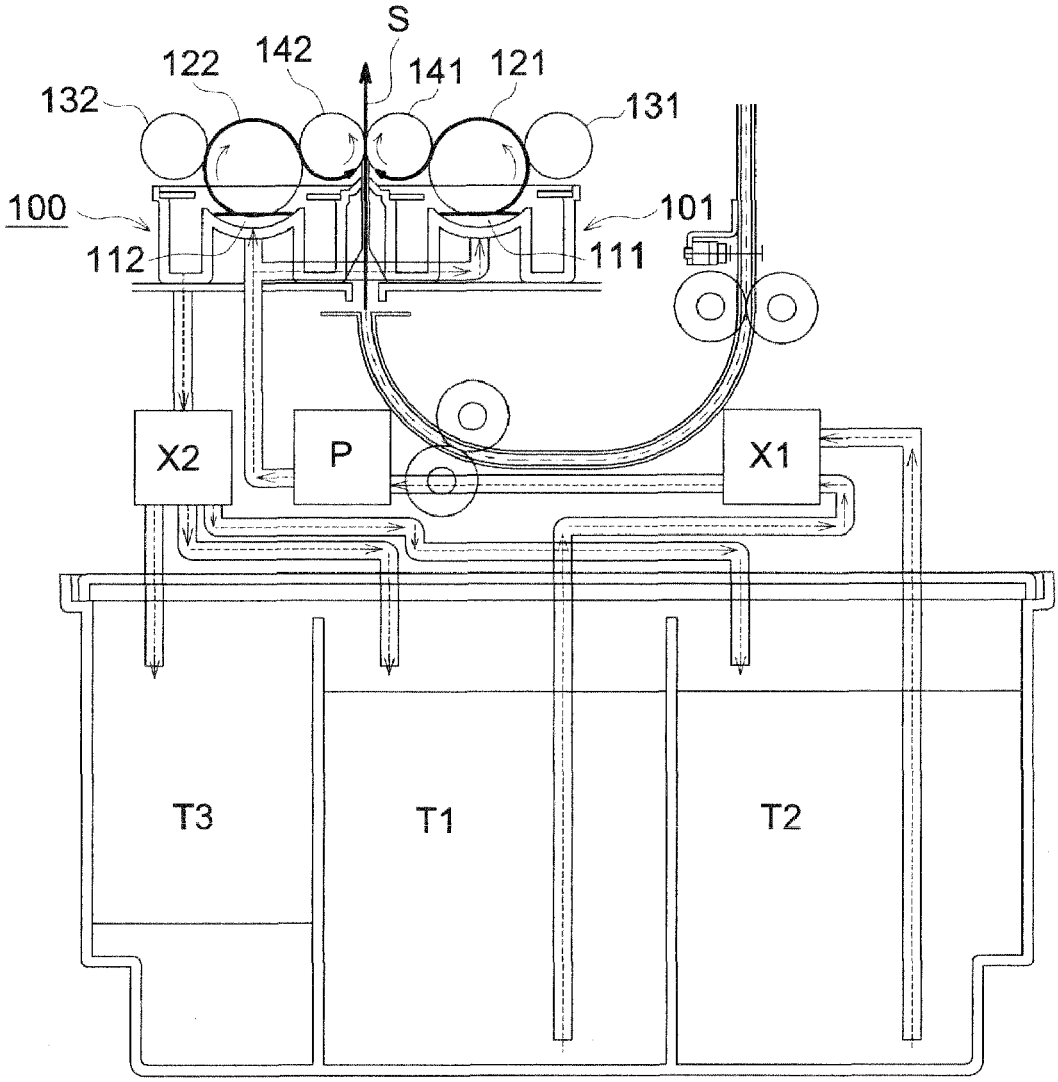
FIG. 4 is a schematic diagram of a coating apparatus.

FIG. 4 is a schematic diagram of coating apparatus 100.

Coating apparatus 100 executes the coating of coloring liquid or colorless water on both faces of paper sheet S while vertically conveying paper sheet S, by two coating rollers arranged to be opposed with each other.

As shown in FIG. 4, coating apparatus 100 includes a plurality of members symmetrically arranged being centered by the sheet conveyance path.

Coating apparatus 100 is configured including: coating liquid storage section 101 provided with coating liquid saucers 111 and 112 to contain a certain amount of coating liquid; supply rollers 121 and 122, each portion of whose circumference surfaces being immersed in the liquid in coating liquid saucers 111 and 112; control rollers 131 and 132 adjacent to respective circumferences of supply rollers 121 and 122; and coating rollers 141 and 142 arranged to be opposed with each other and to contact respectively with supply rollers 121 and 122.

Coating liquid saucers 111 and 112 store a certain amount of coloring liquid or water sent from tank T1 or T2 by pump P, and the coloring liquid or the water overflowed from the saucers flows-out to a prescribed portion of coating liquid storage section 101.

The coloring liquid or the water flowed-out is returned to tank T1 or tank T2, as explained above, and is reused.

Supply rollers 121 and 122 rotate in a state such that each has a portion of a circumferential surface thereof immersed in the liquid in coating liquid saucers 111 and 112. Supply rollers 121 and 122 are made including a solid gum member for example NBR (nitrile-butadiene rubber).

Control rollers 131 and 132 are arranged to keep a prescribed gap respectively from supply rollers 121 and 122, or to press with a prescribed pressing force respectively to supply rollers 121 and 122.

By control rollers 131 and 132, an amount of coating liquid, attached by dipping, on the circumference of supply rollers 121 and 122 is controlled to be constant.

The coating liquid on the circumference of supply rollers 121 and 122 is transferred onto coating rollers 141 and 142, and subsequently transferred onto paper sheet S from coating rollers 141 and 142.

Meanwhile, since the colored water or the colorless water as the coating liquid hardly adheres to a hydrophobic toner image on paper sheet S, the toner image itself is not colored.

As shown in FIG. 4, since paper sheet S is conveyed upward from below, formation of liquid puddle between each of coating rollers 141-142 and paper sheet S is prevented, and as the result, uneven coating is reduced.

Further, since each of coating rollers 141 and 142 has the same diameter, it is easy to apply he same amount of coating on each of both faces of paper sheet S, and conveyance of paper sheet S is stabilized.

As described above, the image forming system is realized which executes the coloring process or the humidifying process to paper sheet S on which an image has been formed by image forming apparatus A, and binds the processed paper sheet S to form a book.

Each apparatus composing the above described image forming system can be combined and operated to sequentially execute the prescribed processes, or otherwise, can be separated to each apparatus and is separately operated to execute the prescribed processes by batch processing.

Further, another configuration is possible where the paper coloring apparatus is arranged in the image forming apparatus or in the book binding apparatus.

According to the present invention, a paper coloring apparatus is realized which colors an image formed paper sheet at high speed.

What is claimed is:

1. An image forming system comprising:

an electrophotographic image forming apparatus which forms an image on a sheet of paper; and a paper coloring apparatus which is connected to the electrophotographic image forming apparatus, and which comprises a coating apparatus that coats colored water on both faces of the paper sheet on which the image has been formed by the electrophotographic image forming apparatus.

2. The image forming system of claim 1, further comprising:

a sheet conveyance section which varies a conveying speed of the paper sheet, wherein the sheet conveyance section is provided in at least one of a first sheet conveyance path to take the paper sheet into the paper coloring apparatus, and a second sheet conveyance path to send the paper sheet out of the paper coloring apparatus.

3. The image forming system of claim 1, wherein:

the coating apparatus comprises two coating rollers arranged to be opposed to each other, the two coating rollers are adapted to have thin layers of the colored water formed on circumferential surfaces thereof, and the two coating rollers are adapted to color the paper sheet when the thin layers of the colored water are formed on the circumferential surfaces of the two coating rollers and the paper sheet is conveyed upward by the two coating rollers therebetween.

4. The image forming system of claim 3, wherein diameters of the two coating rollers are identical.

5. The image forming system of claim 3, wherein further comprising:

a supply section which selectively supplies one of the colored water and a colorless water onto the two coating rollers, and wherein the two coating rollers are adapted to have thin layers of the colorless water formed on the circumferential surfaces thereof when the colorless water is supplied onto the two coating rollers, and the paper sheet is humidified by being conveyed with the two coating rollers when the colorless water is supplied onto the two coating rollers.

6. The image forming system of claim 5, further comprising:

a controller which switches between a coloring process to color the paper sheet by supplying the colored water onto the two coating rollers, and a humidifying process to humidify the paper sheet by supplying the colorless water onto the two coating rollers.

7. The image forming system of claim 6, further comprising:

a waste liquid tank to receive excess of the one of the colored water and the colorless water supplied by the controller onto the two coating rollers.

8. The image forming system of claim 1, wherein the image forming system has a coloring mode to execute a coloring process on the paper sheet and a humidifying mode to execute a humidifying process on the paper sheet, and wherein at least one of the image forming apparatus and the paper coloring apparatus comprises an operation display section for executing an instruction operation to switch between the coloring mode and the humidifying mode.

9. The image forming system of claim 1, further comprising:

a book binding apparatus which executes book binding with respect to a plurality of paper sheets on which images have been formed by the electrophotographic image forming apparatus, and wherein the book binding apparatus is connected to the paper coloring apparatus downstream of the paper coloring apparatus in a conveyance direction of the paper sheets.

* * * * *